US008284110B2

(12) United States Patent
Elliot et al.

(10) Patent No.: US 8,284,110 B2
(45) Date of Patent: Oct. 9, 2012

(54) COMPACT ULTRA-WIDE BANDWIDTH ANTENNA WITH POLARIZATION DIVERSITY

(75) Inventors: Paul G. Elliot, Acton, MA (US); Eddie N. Rosario, Methuen, MA (US); Robert J. Davis, Waltham, MA (US)

(73) Assignee: MITRE Corporation, McLean, VA (US)

( * ) Notice: Subject to any disclaimer, the term of this patent is extended or adjusted under 35 U.S.C. 154(b) by 316 days.

(21) Appl. No.: 12/793,534

(22) Filed: Jun. 3, 2010

(65) Prior Publication Data

US 2011/0298679 A1 Dec. 8, 2011

(51) Int. Cl.
*H01Q 21/00* (2006.01)

(52) U.S. Cl. ..... 343/727; 343/725

(58) Field of Classification Search ..... 343/725, 343/727, 794, 797, 820
See application file for complete search history.

(56) References Cited

U.S. PATENT DOCUMENTS

| | | | | |
|---|---|---|---|---|
| 2,498,655 | A | 7/1947 | Faymoreau et al. | |
| 3,739,390 | A | 6/1973 | Poppe, Jr. et al. | |
| 4,700,196 | A * | 10/1987 | Campbell et al. | 343/797 |
| 4,814,777 | A | 3/1989 | Monser | |
| 5,293,176 | A | 3/1994 | Elliot | |
| 5,367,312 | A * | 11/1994 | Masters | 343/807 |
| 5,418,544 | A | 5/1995 | Elliot | |
| 5,523,767 | A * | 6/1996 | McCorkle | 343/810 |
| 5,796,372 | A | 8/1998 | Elliot | |
| 6,335,706 | B1 | 1/2002 | Elliot | |
| 6,597,316 | B2 | 7/2003 | Rao et al. | |
| 6,693,600 | B1 | 2/2004 | Elliot | |
| 6,720,935 | B2 | 4/2004 | Lamensdorf et al. | |

OTHER PUBLICATIONS

Abbott, A., "Antijamming and GPS for Critical Military Applications," (2002) [online], [retrieved on Nov. 4, 2009]. Retrieved from the Internet http://www.aero.org/publications/crosslink/summer2002/06.html, pp. 36-41.

Ahn, C-H, "A Dual-Frequency Omnidirectional Antenna for Polarization Diversity of MIMO and Wireless Communication Applications," IEEE Antennas and Wireless Propagation Letters, vol. 8 (2009) pp. 966-969.

Compton, R.T. Jr., "The Performance of a Tripole Adaptive Array Against Cross-Polarized Jamming," IEEE Transactions on Antennas and Propagation, vol. AP-31, No. 4, (Jul. 1983) pp. 682-685.

Valenzuela-Valdés, J.F., et al., "The Role of Polarization Diversity for MIMO Systems Under Rayleigh-Fading Environments," IEEE Antennas and Wireless Propagation Letters, vol. 5 (2006) pp. 534-536.

Das, N.K., "An Experiment on MIMO System having Three Orthogonal Polarization Diversity Branches in Multipath-rich Environment," Vehicular Technology Conference, vol. 2 (Sep. 2004), pp. 1528-1532.

Erceg, V., "Dual-Polarization Versus Single-Polarization MIMO Channel Measurement Results and Modeling," IEEE Transactions on Wireless Communications, vol. 5, No. 1 (Jan. 2006) pp. 28-33.

Kang, M., et. al., "Capacity of Correlated MIMO Rayleigh Channels," IEEE Transactions on Wireless Communications, vol. 5, No. 1 (Jan. 2006) pp. 143-155.

(Continued)

*Primary Examiner* — Hoang V Nguyen
(74) *Attorney, Agent, or Firm* — Proskauer Rose LLP

(57) ABSTRACT

Described are methods and apparatus, including a method of manufacture, for a compact antenna. Two biconical dipole antennas and a monocone monopole antenna are displaced in an adjacent and orthogonal configuration. The two biconical dipole antennas are each shunted to the monocone monopole antenna.

26 Claims, 5 Drawing Sheets

OTHER PUBLICATIONS

Mtumbuka, M.C. et al., "Investigation of Tri-Polarised MIMO Technique," Electronics Letters, vol. 41, No. 3 (Feb. 3, 2005), 2 pages.
Nabar, R.U. "Performance of Multiantenna Signaling Techniques in the Presence of Polarization Diversity," IEEE Transactions on Signal Processing, vol. 50, No. 10, (Oct. 2002) pp. 2553-2562.
Ravinder, Y., et. al., "Polarization Diversity Tripole Adaptive Array With Minimum Bit Error Rate Approach," 2006 International Workshop on Satellite and Space Communications (Sep. 14-15, 2006), 5 pages.
Spirent Federal Systems, "High Dynamic GPS/Galileo/GLONASS Simulation System Announced" [online] (May 13, 2008), [retrieved Nov. 4, 2009]. Retrieved from the Internet http://www.rfglobalnet.com/article.mvc/High-Dynamic-GPSGalileoGLONASS-Simulation-0001?VNETCOOKIE=NO, 1 page.
The Institute of Navigation, 2009 ION Fellows [online] (2009), [retrieved Nov. 4, 2009]. Retrieved from the Internet <http://www.ion.org/awards/fellows2009.cfm>, 2 pages.
Valenzuela-Valdés, J.F., et al., "Doubling MIMO Capacity for Handset MIMO Using True Polarization Diversity," 3rd European Conference on Antennas and Propagation (Mar. 23, 2009) pp. 1090-1092.
Valenzuela-Valdés, J.F., et al., "Evaluation of True Polarization Diversity for MIMO Systems," IEEE Transactions on Antennas and Propagation, vol. 57, No. 9 (Sep. 2009) pp. 2746-2755.

* cited by examiner

COMPACT ULTRA-WIDE BANDWIDTH ANTENNA WITH POLARIZATION DIVERSITY

GOVERNMENT RIGHTS

The technology described herein was developed with funding provided by the USAF GPS Wing organization, contract number: FA8721-10-C-0001. The government may have rights in the technology.

FIELD OF THE INVENTION

The invention relates generally to antennas for receiving and transmitting electromagnetic waves, including methods of manufacturing a compact antenna, and methods for increasing impedance bandwidth in a compact antenna.

BACKGROUND

As demand for mobile phone, mobile email, internet access, multimedia services, military communications and other broadband applications increases, the need for high data-rate and high capacity wireless systems increases. However, radio spectrum availability remains substantially constant. Therefore, it is desirable to increase spectral efficiency (more bits per second per hertz of bandwidth) and link capacity without the use of additional bandwidth.

Multiple-input multiple-output (MIMO) wireless technology employs multiple antennas at a transmitter and/or receiver to produce significant capacity gains over single-input single-output (SISO) systems, using the same bandwidth and transmit power. One aim of MIMO antenna design is to reduce correlation between received signals by exploiting various forms of diversity. For example, spatial diversity (spacing antennas apart), pattern diversity (using antennas with different or orthogonal radiation patterns), and polarization diversity (using antennas with different polarizations).

Spatial diversity requires that antennas are physically spaced apart. In order to achieve significant multiplexing and/or diversity gain, large spacing between multiple antennas is often required. Thus, spatial diversity can only be exploited when sufficient real estate is available. Pattern diversity typically requires multiple beam antennas that are capable of forming simultaneous beams in numerous different directions. Multiple bean antennas are typically complex, large, expensive, often have a limited bandwidth and typically have side lobes that can reduce their effectiveness.

Polarization diversity uses antennas with orthogonal polarizations, for example, horizontal and vertical, ±slant 45°, or left-hand and right hand circular polarization. Polarization diversity can also be achieved with three orthogonal antennas (e.g., tri-pole, tri-axial, tri-polarized, or triple axis antennas). Typically the three orthogonal antennas are co-located. Although polarization diversity can immunize a system from polarization mismatches that would otherwise cause signal fade, current polarization diversity antennas are not compact and do not have a wide frequency bandwidth.

Many civilian and military applications use Global Positioning Systems (GPS) and Global Navigation Satellite System (GNSS) for positioning, navigation, and timing. GPS and GNSS systems are susceptible to intentional and unintentional interference (e.g., jamming, a technique used by adversaries to distort signals). A Controlled-Reception-Pattern Antenna Array (CRPA) can form nulls to minimize interference, and can also suppress multipath signals. Existing CRPAs have limited bandwidth, rendering them unsuitable for use over numerous frequencies or over wide bandwidths (e.g., GNSS or GPS). CRPAs can also form very narrow nulls and are limited in the number of interfering sources that can be nulled. In addition, CRPAs are usually large (e.g., 35 centimeters in diameter) making them unusable on equipment that lacks sufficient mounting space (e.g., small missiles). Therefore, it is desirable to provide a compact, extremely wideband antenna, that can simultaneously null entire sectors of the sky.

SUMMARY OF THE INVENTION

In one aspect, the invention features, a compact antenna. The compact antenna includes a first biconical dipole antenna, a second biconical dipole antenna adjacent to and at least substantially orthogonal to the first biconical antenna, and a monocone monopole antenna adjacent to and at least substantially orthogonal to the first biconical antenna and the second biconical antenna. The compact antenna also includes one or more electrically conductive members that shunt at least one of the first biconical dipole antenna or the second biconical dipole antenna to the monocone monopole antenna.

In some embodiments, the antenna transmits or receives a plurality of electromagnetic signals each having different polarizations. In some embodiments, the first biconical dipole antenna and the second biconical dipole antenna are at least substantially parallel to a ground plane and the monocone monopole antenna is between the ground plane and the first biconical dipole antenna and the second biconical dipole antenna.

In some embodiments, the first biconical dipole antenna includes a first cone element and a second cone element, a first electrically conductive member in contact with the first cone element and the monocone monopole antenna and a second electrically conductive member in contact with the second cone element and the monocone monopole antenna. In some embodiments, the second biconical dipole antenna includes a first cone element and a second cone element, a first electrically conductive member in contact with the first cone element and the monocone monopole antenna and a second electrically conductive member in contact with the second cone element and the monocone monopole antenna.

In some embodiments, the compact antenna includes a first feed point for the first biconical dipole antenna and a second feed point for the second biconical dipole antenna, the second feed point adjacent the first feed point and an axis of rotation of the monocone monopole antenna. In some embodiments, the compact antenna includes a third feed point for the monocone monopole antenna, the third feed point located adjacent to a ground plane and the axis of rotation of the monocone monopole antenna.

In some embodiments, the compact antenna includes one or more electrically conductive members that are each in contact with and extend vertically from a rim on the monocone monopole antenna to shunt the monocone monopole antenna to a ground plane. In some embodiments, the antenna occupies a volume having dimensions that are each less than or equal to about ¼ wavelength of a lowest frequency of operation. In some embodiments, the antenna is impedance matched to one or more feed lines over about an octave frequency band, wherein the one or more feed lines feed the first biconical dipole antenna and the second biconical dipole antenna.

In some embodiments, lengths of the first biconical dipole antenna, the second biconical dipole antenna, and the monocone monopole antenna are each dimensioned for maximum impedance bandwidth, pattern bandwidth, and pattern shape.

In some embodiments, flare angles of the first biconical dipole antenna, the second biconical dipole antenna, and the monocone monopole antenna are each dimensioned for maximum impedance bandwidth, pattern gain bandwidth, and pattern shape.

In some embodiments, the one or more electrically conductive members are each in contact with the monocone monopole antenna and one of the first biconical dipole antenna and the second biconical dipole antenna. In some embodiments, contact locations of the one or more electrically conductive members are optimized for maximum impedance bandwidth, pattern gain bandwidth, and pattern shape.

In some embodiments, the compact antenna is impedance matched to one or more feed lines at about 50 ohms, wherein the one or more feed lines feed the first biconical dipole antenna and the second biconical dipole antenna.

In some embodiments, the contact antenna includes an antenna feed system shared by the first biconical dipole antenna, the second biconical dipole antenna and the monocone monopole antenna, wherein the antenna feed system is configured to provide an electromagnetic signal to and from the antenna feed, wherein the electromagnetic signal has a phase and an amplitude at the first biconical dipole antenna, the second biconical dipole antenna and the monocone monopole antenna and is selected to produce a desired antenna radiation pattern, reception pattern, or any combination thereof.

In some embodiments, the contact antenna includes an antenna electronics unit configured to provide an electromagnetic signal to and from the antenna feed system, wherein the electromagnetic signal has a phase and an amplitude at the first biconical dipole antenna, the second biconical dipole antenna and the monocone monopole antenna and is selected to produce a desired antenna radiation pattern, reception pattern, or any combination thereof. In some embodiments, the electromagnetic signal produces a wide-band nulled region or a high energy region.

In another aspect, the invention features a method for manufacturing an antenna/The method involves arranging a first biconical dipole antenna at least substantially orthogonal to a second biconical dipole antenna, arranging a monocone monopole antenna at least substantially orthogonal to the first biconical dipole antenna and the second biconical dipole antenna and arranging a first antenna feed point for the first biconical dipole antenna adjacent to a second antenna feed point for the second biconical dipole antenna and an axis of rotation of the monocone monopole antenna. The method also involves shunting at least one of the first biconical dipole antenna or the second biconical dipole antenna to the monocone monopole antenna.

In some embodiments, the method involves a third feed point for the monocone monopole antenna, the third feed point located adjacent to a ground plane and the axis of rotation of the monocone monopole antenna and arranging a first antenna feed for the first biconical dipole antenna and a second antenna feed for the second biconical dipole antenna and a third feed for the monocone monopole antenna.

In another aspect, the invention involves, a method for transmitting and receiving electromagnetic energy in a compact antenna. The method involves providing a first biconical dipole antenna, a second biconical dipole antenna and a monocone monopole antenna, each plane disposed adjacent and at least substantially orthogonal relative to one another, shunting at least one of each conical element of the first biconical dipole antenna and the second biconical dipole antenna to the monocone monopole antenna and providing electromagnetic energy to at least a first feed point for the first biconical dipole antenna, the first feed point adjacent a second feed point for the second biconical dipole antenna and an axis of rotation of the monocone monopole antenna In some embodiments, the method involves shunting the first biconical dipole antenna and the second biconical dipole antenna to the monocone monopole antenna such that dimensions of a volume occupied by the first biconical dipole antenna, the second biconical dipole antenna, and the monocone monopole antenna are each less than or equal to about ¼ wavelength of a lowest frequency of operation.

In some embodiments, the method involves transmitting or receiving a plurality of electromagnetic signals each having different polarizations. In some embodiments, the plurality of electromagnetic signals include circularly polarized signals, linearly polarized signals, or any combination thereof. In some embodiments, the method involves providing an electromagnetic signal having an optimized phase and amplitude to each of the first biconical dipole antenna, the second biconical dipole antenna and the monocone monopole antenna, generate a wide-band nulled. In some embodiments, the method involves transmitting or receiving an electromagnetic signal having an electrical field polarization oriented in a first orthogonal axis, a second orthogonal axis, a third orthogonal axis, or any combination thereof.

The systems and methods of the present invention provide a number of advantages. One advantage of the present invention is that it provides a compact antenna suitable for MIMO polarization diversity, for use as a CRPA antenna, and/or for navigation, communication, radar and other wideband systems. The antenna of the present invention can exhibit a 2:1 frequency bandwidth, overall size less than ¼ wavelength diameter, and a height at the lowest frequency of operation.

Although the present invention is compact, it provides a wide bandwidth, right-hand circular polarization, left-hand circular polarization, and tri-axial orthogonal linear polarizations. Another advantage of the present invention is that it can produce wideband sector nulls in desired directions.

Another advantage of the present invention is that the impedance, gain and radiation patterns do not substantially change with frequency. In turn, phase and amplitude weights used for nulling do not have to be adjusted for a different frequency. Another advantage of the present invention is that there is low mutual coupling between the monocone monopole antenna and the two biconical dipole antennas.

Other aspects and advantages of the invention will become apparent from the following detailed description, taken in conjunction with the accompanying drawings, illustrating the principles of the invention by way of example only.

BRIEF DESCRIPTION OF THE DRAWINGS

The foregoing and other objects, features, and advantages of the invention, as well as the invention itself, will be more fully understood from the following description of various embodiments, when read together with the accompanying drawings.

DETAILED DESCRIPTION

Figure 1:
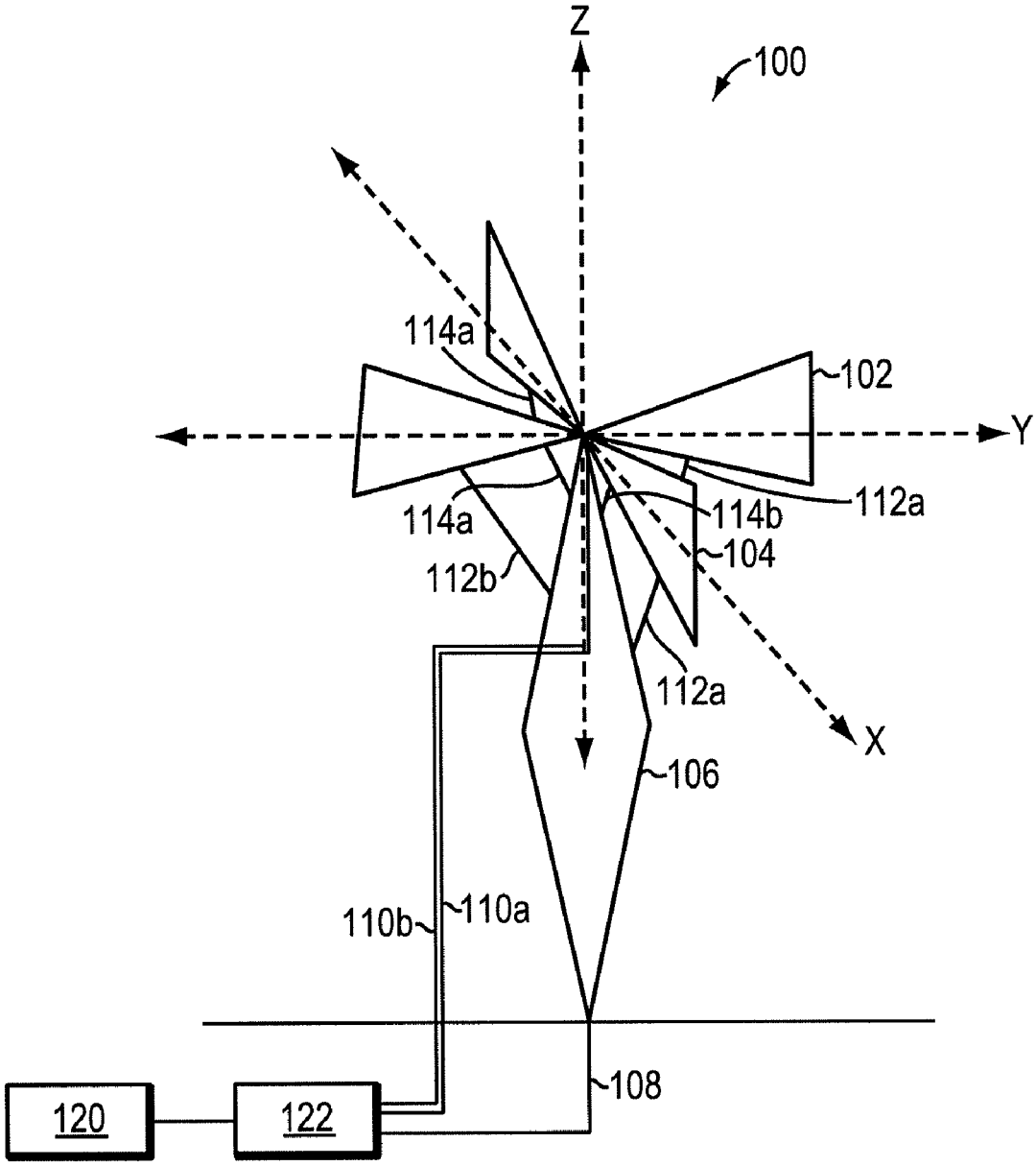
FIG. 1 is diagram showing an exemplary antenna system, according to an embodiment of the present invention.

FIG. 1 is diagram 100 showing an exemplary antenna system, according to an embodiment of the present invention. The antenna system includes a first biconical dipole antenna 102, a second biconical dipole antenna 104, a monocone monopole antenna 106, a first feed line 108 to the monocone monopole antenna 106, a second feed line 110*a* to the first biconical dipole antenna 102, a third feed line 110*b* to the second biconical dipole antenna 104, and a first biconical dipole antenna shunt 112*a*, a second biconical dipole antenna shunt 112*b*, a third biconical dipole antenna shunt 114*a*, and a fourth biconical dipole antenna shunt 114*b*, an antenna feed system 122, and a transmitter/receiver 120.

The first biconical dipole antenna 102 disposed substantially orthogonal to the second biconical dipole antenna 104. The monocone monopole antenna 106 is disposed substantially perpendicular to a ground plane 116 and between the two biconical dipole antennas 102 and 104. The spatial relationship between the first biconical dipole antenna 102, the second biconical dipole antenna 104, and the monocone monopole antenna 106, is considered as substantially orthogonal. In the field, the bicones can droop or rise upwards and the spatial relationship between the bicones and monocone is considered to remain substantially orthogonal. Moreover, bicones and monocones are three dimensional objects, so it is the axis of the bicones and monocones that are substantially orthogonal. For example, if an axis of the first biconical dipole antenna 102 is along the Y direction, and an axis of the second biconical dipole antenna 104 is along the X direction, and an axis of the monocone monopole antenna 106 is along the Z direction, the three axis are orthogonal.

In some embodiments, the first biconical dipole antenna 102 and the second biconical dipole antenna 104 are substantially parallel to the ground plane 116. In some embodiments, the first biconical dipole antenna 102 droops downward from its center toward the ground plane 116. In some embodiments, the first biconical dipole antenna 102 rises upwards from its center away from the ground plane 116. In some embodiments, the second biconical dipole antenna 104 droops downward from its center toward the ground plane 116. In some embodiments, the second biconical dipole antenna 104 rises upwards from its center away from the ground plane 116. In some embodiments, the first feed line 108 is located on an opposite side of the ground plane 116 from the monocone monopole antenna 106. In some embodiments, the second feed line 110*a* and the third feed line 110*b* are located, in part, on both sides of the ground plane 116.

In some embodiments, the first biconical dipole antenna 102, the second biconical dipole antenna 104, and the monocone monopole antenna 106 are arranged to fit within a cube of maximum length, width and height each less than ¼ wavelength at the lowest operating frequency, and with close to 2:1 operating frequency band. In some embodiments, the antenna system is 2.8 inches wide by 2.3 inches high. In some embodiments, the antenna system is 13 inches wide by 13 inches high. In some embodiments, the antenna system operates over the frequency range of 1-2 GHz. In some embodiments, the antenna system operates over the frequency range of 200-400 MHz.

In various embodiments, the antenna system transmits circularly polarized signals. In various embodiments, the antenna system transmits linearly polarized signals. In various embodiments, the antenna system transmits both circularly polarized signals and linearly polarized signals.

In various embodiments, the ground plane 116 is removed and some or all of the antenna system elements shown in FIG. 1 are duplicated and connected to the antenna and the antenna feed system. It is apparent to one of ordinary skill in the art that duplicating antenna elements as reflected in the ground plane and connecting the duplicated elements to the antenna system by using image theory achieves substantially similar antenna and antenna feed system performance to the antenna system with the ground plane.

In addition to being disposed relative to the monocone monopole antenna 106, the first biconical dipole antenna 102 and the second biconical dipole antenna 104 are each shunted to the monocone monopole antenna 106. Specifically, a first biconical dipole antenna shunt 112*a* and a second biconical dipole antenna shunt 112*b* are connected from the first biconical dipole antenna 102 to the monocone monopole antenna 106. A third biconical dipole antenna shunt 114*a* and a fourth biconical dipole antenna shunt 114*b* are connected from the second biconical dipole antenna 104 to the monocone monopole antenna 106. The first biconical dipole antenna shunt 112*a*, the second biconical dipole antenna shunt 112*b*, the third biconical dipole antenna shunt 114*a*, and the fourth biconical dipole antenna shunt 114*b* can be electrical conductors.

In some embodiments, the first biconical dipole antenna shunt 112*a* connects a first cone (or pole) of the first biconical dipole antenna 102 to the monocone monopole antenna 106 and the second biconical dipole antenna shunt 112*b* connects a second cone (or pole) of the first biconical dipole antenna 102 to the monocone monopole antenna 106. In some embodiments, the third biconical dipole antenna shunt 114*a* connects a first cone (or pole) of the second biconical dipole antenna 104 to the monocone monopole antenna 106 and the fourth biconical dipole antenna shunt 114*b* connects a second cone (or pole) of the second biconical dipole antenna 102 to the monocone monopole antenna 106. In some embodiments, one biconical dipole antenna shunts is connected from the first biconical dipole antenna 102 to the monocone monopole antenna 106.

In various embodiments, the first biconical dipole antenna shunt 112 is positioned between the first biconical dipole antenna 102 and the monocone monopole antenna 106 such that the first biconical dipole antenna shunt 112 achieves a desired impedance bandwidth, a desired pattern gain bandwidth and a desired pattern shape. In various embodiments, the second biconical dipole antenna shunt 114 is positioned between the second biconical antenna 104 and the monocone monopole antenna 106 such that the second biconical dipole antenna 114 achieves a desired impedance bandwidth, a desired pattern gain bandwidth and a desired pattern shape. In some embodiments, the first biconical dipole antenna shunt 112*a*, the second biconical dipole antenna shunt 112*b*, the third biconical dipole antenna shunt 114*a*, and/or the fourth biconical dipole antenna shunt 114*b* produces an antenna impedance of 50 ohms over the desired bandwidth. In some embodiments, at least one of the first biconical dipole antenna 102, the second biconical dipole antenna 104, and the monocone monopole antenna 106 has an impedance bandwidth of 10:1.

The first biconical dipole antenna 102, the second biconical dipole antenna 104 and the monocone monopole antenna 106 can be fed by an antenna feed system 122 via the first feed line 108, the second feed line 110*a*, and the third feed line 110*b*. The antenna feed system 122 is connected by any conventional means to the transmitter/receiver 120. The second feed line 110*a* and the third feed line 110*b* can be co-located, such that the second feed line 110*a* that feeds the first biconical dipole antenna 102 and the third feed line that 110*b* feeds the second biconical dipole antenna 104 are adjacent. The first feed line 108 to the monocone monopole antenna 106, the second feed line 110*a* to the first biconical dipole antenna 102, and the third feed line 110*b* to the second biconical dipole antenna 104 can be connected to the antenna system in various ways. Various feed lines, configurations and connections are described U.S. Pat. No. 6,335,706, which is incorporated herein by reference.

Antenna radiation patterns can be formed by transmitting or receiving an RF signal with a phase and amplitude to at least one of the biconical dipole antennas and the monocone monopole antenna. The antenna patterns can be circularly polarized, linearly polarized, or some combination of both. The antenna patterns can be adjusted by arrangement the elements shown in FIG. 1 and selecting the phase and amplitude of the RF signals transmitted or received. In some embodiments, the antenna feed system can adjust the RF signals transmitted or received.

In some embodiments, wideband nulls can be created in the radiation patterns. In these embodiments, circular polarization or linear polarization can be used. For example, the antenna system can create a null bandwidth of about 150 MHz, centered on 1575, in which case the null bandwidth (e.g., 150 MHz) is approximately 10% of a 2:1 octave antenna bandwidth from 1 to 2 GHz.

In some embodiments, the patterns include nulls that have an azimuth sector ranging from 20 degrees to 360 degrees. In some embodiments, the patterns include nulls along an elevation range of 0 degrees to 180 degrees. In some embodiments, the antenna system creates a null and an opposite peak, so that comparing the null and peak allows for a location of an emitter to be determined.

In some embodiments, the antenna system transmits and receives signals for all GNSS frequencies (e.g., GPS, GPS modernization, European Galileo, Russian GLONASS, and Chinese Beidou). In various embodiments, the antenna system is mounted on unmanned air vehicles (UAVs), missiles, aircraft, ground vehicles, ships, and/or at stationary locations. In various embodiments, the antenna system is used as part of a MIMO communication system. In various embodiments, the antenna system is used for transmission and/or reception of polarization diverse electromagnetic signals. In various embodiments, the antenna system is used for transmission and/or reception of wideband electromagnetic signals.

Figure 2:
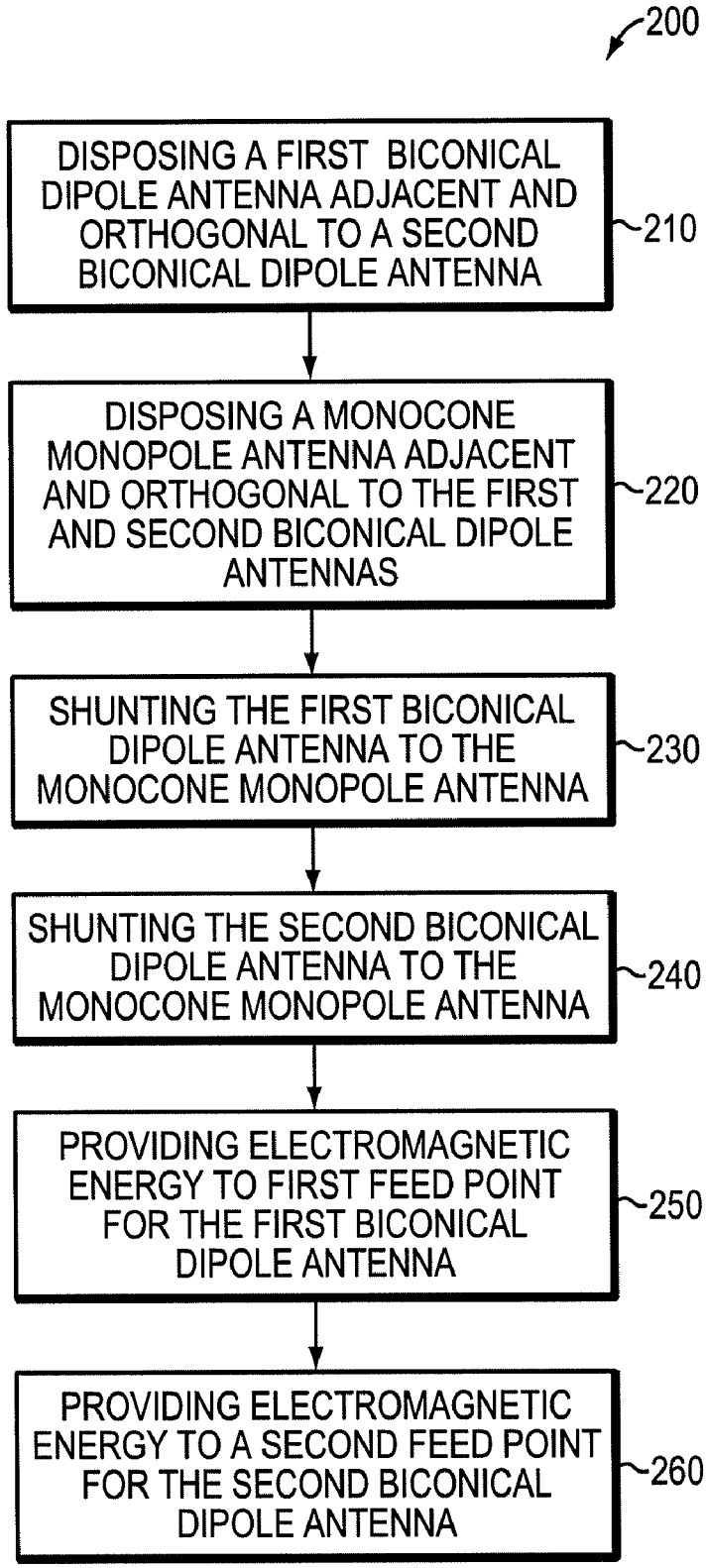
FIG. 2 is a flow diagram of an exemplary method for transmitting and receiving electromagnetic energy in a compact antenna.

FIG. 2 is a flow diagram 200 of an exemplary method for transmitting and receiving electromagnetic energy in a compact antenna. The method for transmitting and receiving electromagnetic energy includes disposing a first biconical dipole antenna adjacent and orthogonal to a second biconical dipole antenna (Step 210). The method also includes disposing a monocone monopole antenna adjacent and orthogonal to the first and second biconical dipole antennas (Step 220).

The method also includes shunting the first biconical dipole antenna to the monocone monopole antenna (Step 230). The method also includes shunting the second biconical dipole antenna to the monocone monopole antenna (Step 240).

The method also includes providing electromagnetic energy to a first feed point for the first biconical dipole antenna (Step 250). The method also includes providing electromagnetic energy to a second feed point for the second biconical dipole antenna (Step 260).

In some embodiments, the method also includes providing electromagnetic energy to a third feed point for the monocone monopole antenna.

Figure 3:
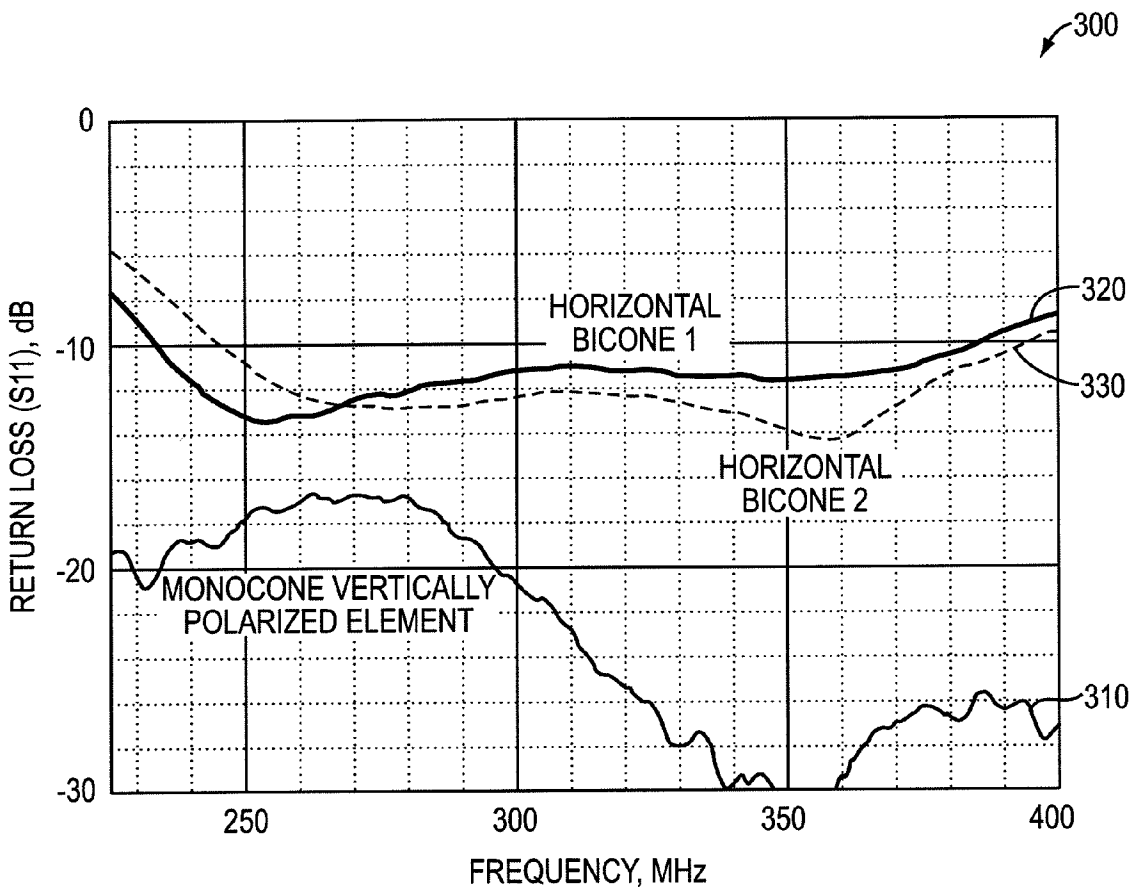
FIG. 3 is a graph of return loss for an antenna system, according to an embodiment of the present invention.

FIG. 3 is a graph 300 of return loss (S11) for an antenna system, according to an embodiment of the present invention. The return loss shown in FIG. 3 is for an antenna system that is less than 13 inches×13 inches×13 inches in length, width, and height, respectively, operating in a UHF/VHF range with a monocone monopole antenna, and two biconical dipole antenna, each antenna disposed adjacent and orthogonal to the other, as described above in FIG. 1 and FIG. 2. Graph lines 320 and 330 show that the return loss for the first biconical dipole antenna and the second biconical dipole antenna is less than −10 dB over the entire UHF/VHF range from 248 MHz to 384 MHz, is less than −8 dB over the entire UHF/VHF range from 240 MHz to 400 MHz, and is less than −5.8 dB over the entire UHF/VHF range from 225 MHz to more than 400 MHz. Graph line 310 shows a return loss for the monocone monopole antenna that is less than −16 dB over an entire range from 225 to 400 MHz.

Figure 4:
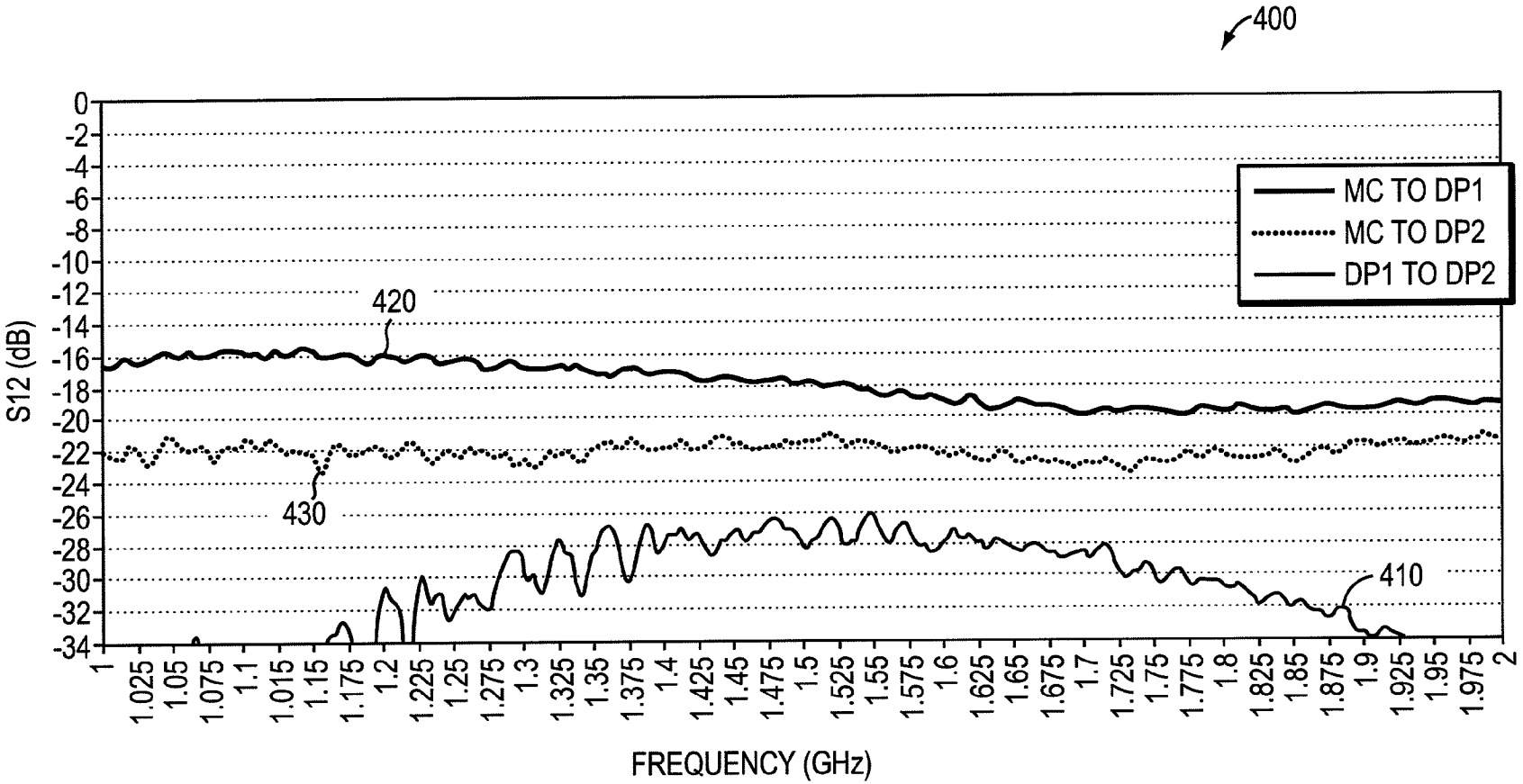
FIG. 4 is a graph of mutual coupling for an antenna system, according to an embodiment of the present invention.

FIG. 4 is a graph 400 of mutual coupling for an antenna system, according to an embodiment of the present invention. The mutual coupling shown in FIG. 4 is for an antenna system operating in an L-band range with a monocone monopole antenna, and two biconical dipole antenna, each antenna disposed adjacent and orthogonal to the other, as described above in FIG. 1 and FIG. 2. Graph line 410 shows the mutual coupling between the first biconical dipole antenna and the second biconical dipole antenna. Graph line 420 shows the mutual coupling between the monocone monopole antenna and the first biconical dipole antenna. Graph line 430 shows the mutual coupling between monocone monopole antenna and the second biconical dipole antenna. Low mutual coupling contributes to a wide instantaneous signal bandwidth of the antenna system.

Figure 5:
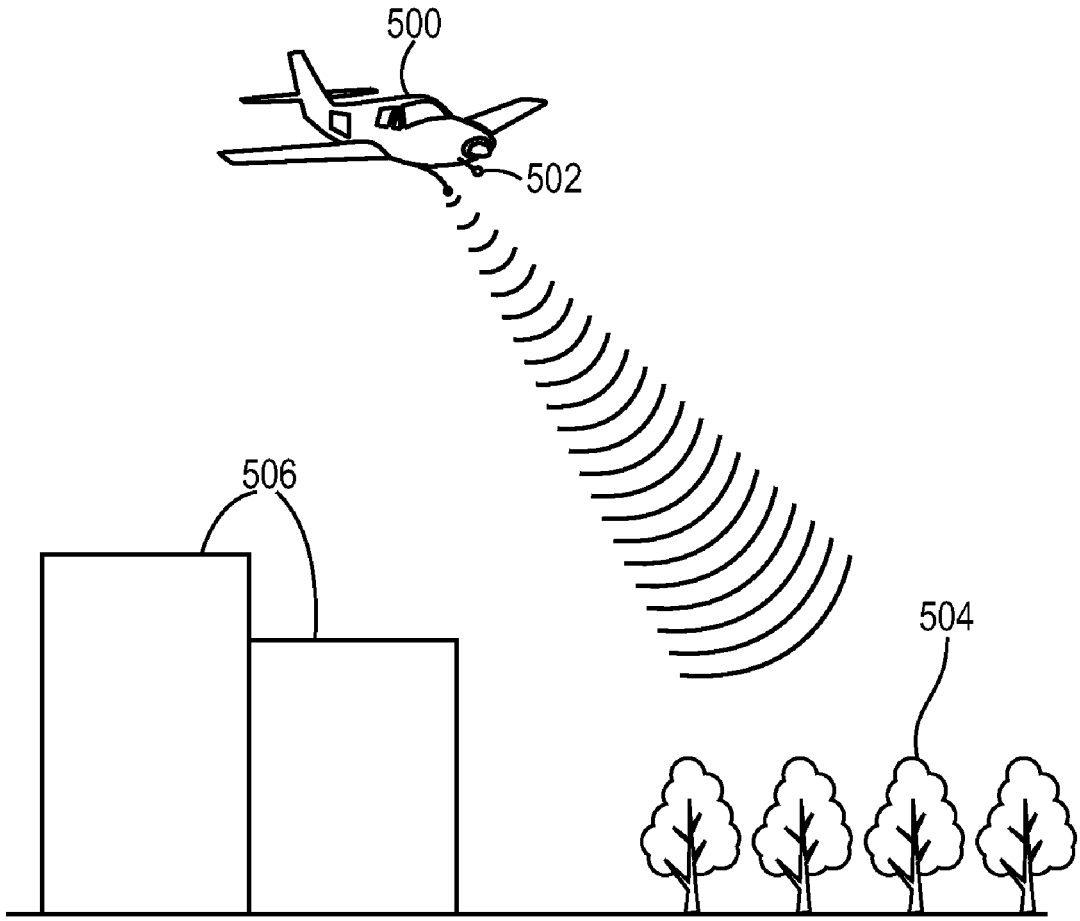
FIG. 5 is a diagram of an exemplary antenna system mounted on an aircraft.

FIG. 5 is a diagram of an exemplary antenna system mounted on an aircraft 500. Aircraft 500 includes an antenna system 502 mounted thereon. The antenna system 502 is transmitting and/or receiving from a direction towards trees 504. The antenna system 502 can be receiving and/or transmitting to create nulls toward jamming equipment buried in trees 504. The antenna system can switch its transmitting and/or receiving direction towards building 506. If deployed on top of the aircraft, the antenna system can receive GPS or GNSS signals from a wide area of the sky, and simultaneously place nulls towards jamming equipment (e.g., jamming equipment located at the horizon).

While the invention has been particularly shown and described with reference to specific embodiments, it should be understood by those skilled in the art that various changes in form and detail may be made therein without departing from the spirit and scope of the invention as defined by the appended claims.

What is claimed:

1. A compact antenna, comprising:

a first biconical dipole antenna;

a second biconical dipole antenna adjacent to and at least substantially orthogonal to the first biconical antenna;

a monocone monopole antenna adjacent to and at least substantially orthogonal to the first biconical antenna and the second biconical antenna; and one or more electrically conductive members that shunt at least one of the first biconical dipole antenna or the second biconical dipole antenna to the monocone monopole antenna.

2. The antenna of claim 1, wherein the antenna transmits or receives a plurality of electromagnetic signals each having different polarizations.

3. The antenna of claim 1, wherein the first biconical dipole antenna and the second biconical dipole antenna are at least substantially parallel to a ground plane and the monocone monopole antenna is between the ground plane and the first biconical dipole antenna and the second biconical dipole antenna.

4. The antenna of claim 1, wherein the first biconical dipole antenna includes a first cone element and a second cone element, a first electrically conductive member in contact with the first cone element and the monocone monopole antenna and a second electrically conductive member in contact with the second cone element and the monocone monopole antenna.

5. The antenna of claim 1, wherein the second biconical dipole antenna includes a first cone element and a second cone element, a first electrically conductive member in contact with the first cone element and the monocone monopole antenna and a second electrically conductive member in contact with the second cone element and the monocone monopole antenna.

6. The antenna of claim 1, further comprising:

a first feed point for the first biconical dipole antenna; and a second feed point for the second biconical dipole antenna, the second feed point adjacent the first feed point and an axis of rotation of the monocone monopole antenna.

7. The antenna of claim 6, further comprising a third feed point for the monocone monopole antenna, the third feed point located adjacent to a ground plane and the axis of rotation of the monocone monopole antenna.

8. The antenna of claim 1, further comprising one or more electrically conductive members that are each in contact with and extend vertically from a rim on the monocone monopole antenna to shunt the monocone monopole antenna to a ground plane.

9. The antenna of claim 1, wherein the antenna occupies a volume having dimensions that are each less than or equal to about ¼ wavelength of a lowest frequency of operation.

10. The antenna of claim 1, wherein the antenna is impedance matched to one or more feed lines over about an octave frequency band, wherein the one or more feed lines feed the first biconical dipole antenna and the second biconical dipole antenna.

11. The antenna of claim 1, wherein lengths of the first biconical dipole antenna, the second biconical dipole antenna, and the monocone monopole antenna are each dimensioned for maximum impedance bandwidth, pattern bandwidth, and pattern shape.

12. The antenna of claim 1, wherein flare angles of the first biconical dipole antenna, the second biconical dipole antenna, and the monocone monopole antenna are each dimensioned for maximum impedance bandwidth, pattern gain bandwidth, and pattern shape.

13. The antenna of claim 1, wherein the one or more electrically conductive members are each in contact with the monocone monopole antenna and one of the first biconical dipole antenna and the second biconical dipole antenna.

14. The antenna of claim 8, wherein contact locations of the one or more electrically conductive members are optimized for maximum impedance bandwidth, pattern gain bandwidth, and pattern shape.

15. The antenna of claim 1, wherein the antenna is impedance matched to one or more feed lines at about 50 ohms, wherein the one or more feed lines feed the first biconical dipole antenna and the second biconical dipole antenna.

16. The antenna of claim 1, further comprising:

an antenna feed system shared by the first biconical dipole antenna, the second biconical dipole antenna and the monocone monopole antenna, wherein the antenna feed system is configured to provide an electromagnetic signal to and from the antenna feed, wherein the electromagnetic signal has a phase and an amplitude at the first biconical dipole antenna, the second biconical dipole antenna and the monocone monopole antenna and is selected to produce a desired antenna radiation pattern, reception pattern, or any combination thereof.

17. The antenna of claim 16, further comprising an antenna electronics unit configured to provide an electromagnetic signal to and from the antenna feed system, wherein the electromagnetic signal has a phase and an amplitude at the first biconical dipole antenna, the second biconical dipole antenna and the monocone monopole antenna and is selected to produce a desired antenna radiation pattern, reception pattern, or any combination thereof.

18. The antenna of claim 16, wherein the electromagnetic signal produces a wide-band nulled region or a high energy region.

19. A method for manufacturing an antenna, the method comprising:

arranging a first biconical dipole antenna at least substantially orthogonal to a second biconical dipole antenna;

arranging a monocone monopole antenna at least substantially orthogonal to the first biconical dipole antenna and the second biconical dipole antenna;

arranging a first antenna feed point for the first biconical dipole antenna adjacent to a second antenna feed point for the second biconical dipole antenna and an axis of rotation of the monocone monopole antenna; and shunting at least one of the first biconical dipole antenna or the second biconical dipole antenna to the monocone monopole antenna.

20. The method of claim 19, further comprising:

a third feed point for the monocone monopole antenna, the third feed point located adjacent to a ground plane and the axis of rotation of the monocone monopole antenna; and arranging a first antenna feed for the first biconical dipole antenna and a second antenna feed for the second biconical dipole antenna and a third feed for the monocone monopole antenna.

21. A method for transmitting and receiving electromagnetic energy in a compact antenna, the method comprising:

providing a first biconical dipole antenna, a second biconical dipole antenna and a monocone monopole antenna, each plane disposed adjacent and at least substantially orthogonal relative to one another;

shunting at least one of each conical element of the first biconical dipole antenna and the second biconical dipole antenna to the monocone monopole antenna; and providing electromagnetic energy to at least a first feed point for the first biconical dipole antenna, the first feed point adjacent a second feed point for the second biconical dipole antenna and an axis of rotation of the monocone monopole antenna.

22. The method of claim 21, further comprising shunting the first biconical dipole antenna and the second biconical dipole antenna to the monocone monopole antenna such that dimensions of a volume occupied by the first biconical dipole antenna, the second biconical dipole antenna, and the monocone monopole antenna are each less than or equal to about ¼ wavelength of a lowest frequency of operation.

23. The method of claim 22, further comprising providing an electromagnetic signal having an optimized phase and amplitude to each of the first biconical dipole antenna, the second biconical dipole antenna and the monocone monopole antenna, generate a wide-band nulled region or a high energy region.

24. The method of claim 22, further comprising transmitting or receiving an electromagnetic signal having an electrical field polarization oriented in a first orthogonal axis, a second orthogonal axis, a third orthogonal axis, or any combination thereof.

25. The method of claim 21, further comprising transmitting or receiving a plurality of electromagnetic signals each having different polarizations.

26. The method of claim 25, wherein the plurality of electromagnetic signals include circularly polarized signals, linearly polarized signals, or any combination thereof.

* * * * *